United States Patent [19]

Lehr

[11] Patent Number: 4,546,999

[45] Date of Patent: Oct. 15, 1985

[54] FLEXIBLE SKATEGUARD

[76] Inventor: Steven R. Lehr, Box 272, Wadena, Minn. 56482

[21] Appl. No.: 541,133

[22] Filed: Oct. 12, 1983

[51] Int. Cl.[4] ..... A63C 3/12

[52] U.S. Cl. ..... 280/825; 24/71 SK; 24/117; D21/225

[58] Field of Search ..... 280/825; 24/71 SK, 117 R, 24/306, 442; 383/95, 109; D21/225

[56] References Cited

U.S. PATENT DOCUMENTS

| | | | |
|---|---|---|---|
| D. 258,604 | 3/1981 | Sholl | D21/225 |
| 1,028,050 | 5/1912 | McCollum | 280/825 |
| 1,174,601 | 3/1916 | Nathan | 280/825 |
| 1,686,667 | 10/1928 | Kaskey | 280/825 |
| 1,691,558 | 11/1928 | Tolman | 280/825 |
| 2,323,049 | 6/1943 | Johnson | 280/825 |
| 3,106,790 | 10/1963 | Zimmon | 24/442 X |
| 3,135,526 | 6/1964 | Johns | 280/825 |
| 3,583,720 | 6/1971 | Fowlkes | 280/825 |
| 3,826,296 | 7/1974 | Morris | 383/95 |
| 3,955,730 | 5/1976 | Montgomery | 383/109 X |
| 4,196,817 | 4/1980 | Moser | 383/95 X |

*Primary Examiner*—Joseph F. Peters, Jr.
*Assistant Examiner*—Michael Mar
*Attorney, Agent, or Firm*—Kinney & Lange

[57] ABSTRACT

A flexible skateguard includes a pouch constructed of a flexible material. The pouch has first and second wall portions joined at the front, back and bottom and an opening which defines an enclosure for receiving the blade of the skate. A hook and loop fastener is attached to the inner surfaces of the first and second wall portions and is situated so that when the blade is inserted into the pouch and the first and second wall portions are squeezed together, the hook and loop fastener extends through an opening securing the pouch to the blade.

4 Claims, 4 Drawing Figures

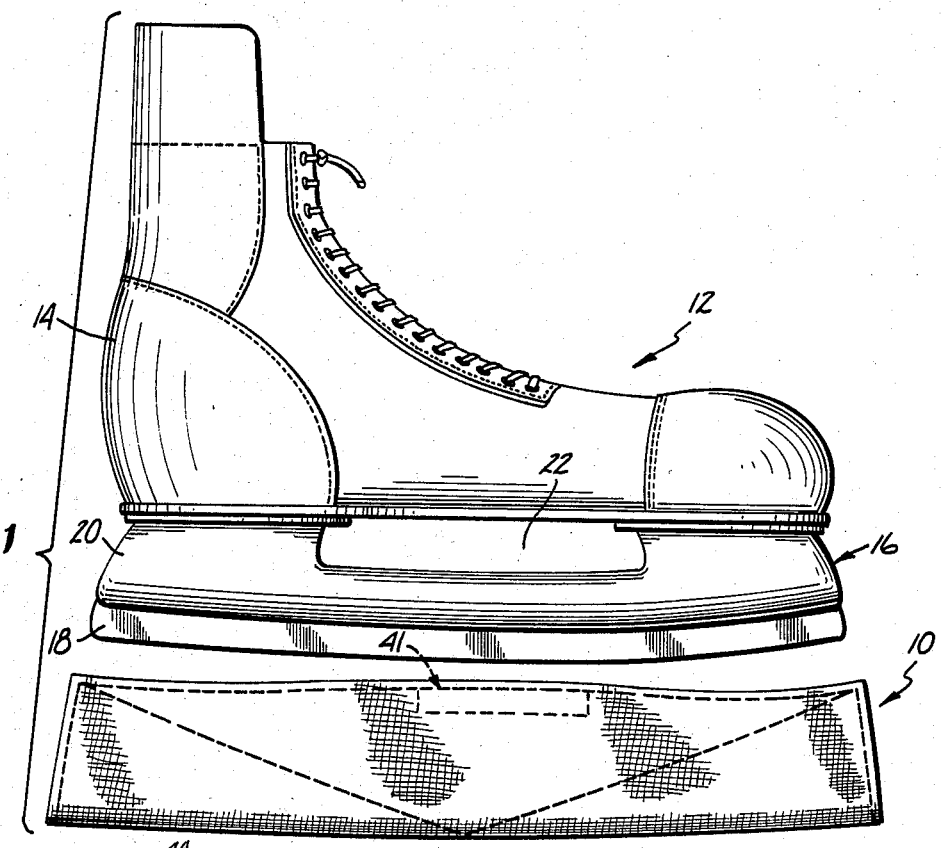
Fig.1
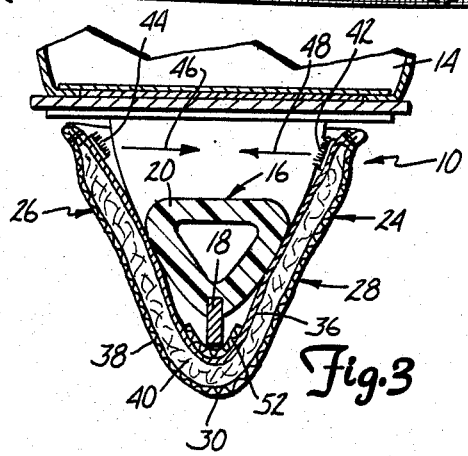
Fig.3
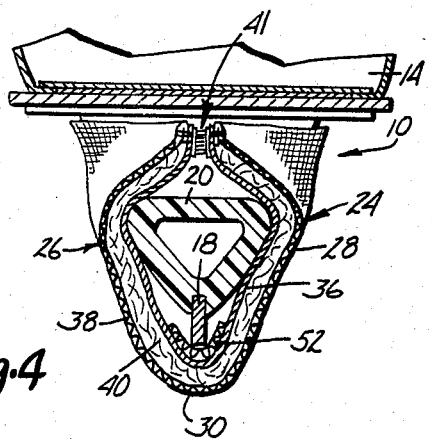
Fig.4
Fig.2
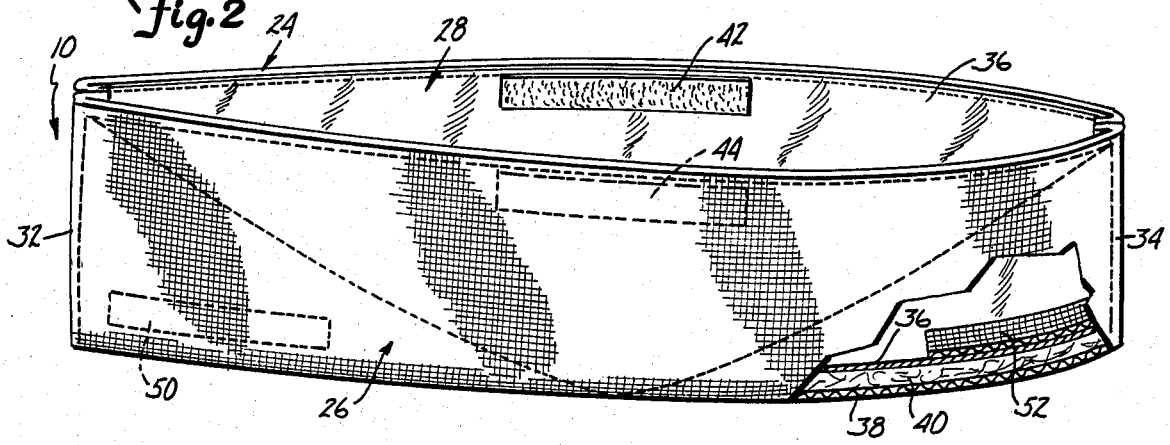

FLEXIBLE SKATEGUARD

BACKGROUND OF THE INVENTION

1. Field of the Invention

The present invention relates to skateguards for ice skate blades, and in particular, to a flexible skateguard which is quickly and easily attached to the skate blade.

2. Description of the Prior Art

In the past, ice skate blade guards were used to protect the blades of the skate from damage as the skater walked over the ground to the ice skating area. To protect the skate blades from damage, the ice skate blade guards were made of stiff or rugged material. Since these skate blade guards were made of stiff or rugged material, the skater had a problem of storing the guard while skating. The ice skate blade guard was either left on the ground, risking loss thereof, or put in a pocket of the clothing of the skater causing an inconvenience.

The skate blade guards of the prior art also have cumbersome fastening means, such as springs or straps, which fasten the skate blade guards to the ice skate blades. An example of a skate blade guard being fastened to an ice skate blade by a spring mechanism is illustrated in the Fowlkes U.S. Pat. No. 3,583,720, the Johns U.S. Pat. No. 3,135,526 and the Kaskey U.S. Pat. No. 1,686,667. An example of an ice skate blade guard fastened to the skate blade by straps is illustrated in the Tolman U.S. Pat. No. 1,691,558, the Nathan U.S. Pat. No. 1,174,601 and the Sholl U.S. Pat. No. Des. 258,604.

A skate guard requiring neither strap or spring mechanism is shown in the Johnson U.S. Pat. No. 2,323,049. The skate blade guard is composed of front and back leather pockets attached by a midsection of elastic webbing. The skateguard is fastened to the skate blade by placing one leather pocket over an end of the skate blade and pulling on the other leather pocket, stretching the elastic webbing and hooking the second leather pocket over the other end of the skate blade.

With the advent of modern skating facilities and transportion, most skaters do not wear their skates to the skating facility. Instead, the skaters typically hand-carry their skates by walking or driving to the skating area. Consequently, the purpose of the prior art skate blade guard has disappeared and a new reason for covering skate blades has arisen. Since the skater now carries the skates containing sharp blades alongside or slung over the shoulder, the skater has to be protected from the sharp blades. In addition, transporting skates in a car can result in the sharp blades damaging the car's interior and upholstery.

Furthermore, today's skater wears streamline functional outdoor wear. The stiff skateguards shown in the prior art are more of an inconvenience than in the past when placed in pockets of today's outdoor wear.

SUMMARY OF THE INVENTION

The present invention includes a completely flexible and foldable skate blade guard which protects the skater from the sharp skate blade, and which, when removed from the skate blade can be folded up and placed in a pocket without any inconvenience or discomfort to the skater. The skate blade guard includes a pouch having first and second flexible wall portions joined at the front, back and bottom and a top opening defining an enclosure for receiving the skate blade. The wall portions are entirely flexible and include an inner wall of fabric, an outer wall of fabric and a cushioning material disposed between the inner and outer walls providing protection from the sharp skate blades. A hook and loop-type fastener is attached to the inner walls of fabric and situated so that when the blade is inserted into the pouch and the first and second wall portions are brought together, the hook component and the loop component of the fastener extend through an opening in the skate blade and contact each other placing the fastener in a fastened state, securing the pouch to the skate blade. When the skater arrives at the ice skating area, the first and second wall portions of the pouch are separated, separating the hook and loop fastener, and the skate blade is removed from the pouch. The ice skate blade guard can then be easily folded up and placed in a pocket in the same manner as a handkerchief.

BRIEF DESCRIPTION OF THE DRAWINGS

FIG. 1 is an elevational view of an ice skate with an ice skate blade guard of the present invention separated from the ice skate blade;

FIG. 2 is a perspective view of the ice skate blade guard of the present invention with a portion cut away to illustrate the structure of a wall portion;

FIG. 3 is a sectional view of the ice skate blade guard being positioned over the ice skate blade; and FIG. 4 is a sectional view of the ice skate blade guard attached to the ice skate blade with the hook and loop-type fastener in a fastened state.

DETAILED DESCRIPTION OF THE PREFERRED EMBODIMENTS

The ice skate blade guard of the present invention is generally indicated at 10 in FIG. 1, and is shown separated from an ice skate 12. The ice skate 12 is a conventional ice skate having a shoe portion 14 with an ice skate blade 16 being suitably fastened to the underside of the shoe 14. The ice skate blade 16 is a hockey blade having a ice engaging lower portion 18 and an upper support portion 20. The support portion 20 is attached to the bottom of the shoe 14 at a forward and rearward section creating an opening 22 between the shoe 14 and the skate blade 16.

It will be understood by those skilled in the art that there are skates having one-piece construction skate blades, such as figure skates, which are not illustrated. These skates also have skate blades with an opening similar to opening 22.

The ice skate blade guard 10 is best illustrated in FIG. 2 and includes a pouch 24 having a first wall portion 26 and a second wall portion 28 preferably of the same piece of material folded over to form a bottom 30. The wall portions 26 and 28 are joined at a forward end 32 and at a rearward end portion 34 by folding the ends over and sewing the ends together. The pouch is of a generally rectangular configuration sufficiently large to cover the skate blade. For example, the pouch will be shorter to cover figure skates and hockey skates and will be longer to cover speed skates.

The pouch 10 has an inner wall of fabric 36, an outer wall of fabric 38 and a layer of cushioning material 40. Preferably, the inner fabric wall 36 is made of a cotton army duck material. The outer fabric wall 38 is made of a net-type of material. Two examples of this net-type of material that have been used are sold under the trademark of Kasualene by Cleantext Inc. of Georgia and under the Trademark of Baylene by Baycor Inc. of Georgia. The cushioning material 40 is preferably a polyester fiber-type fill, such as Dacron fiber fill produced by I. E. Du Pont de Nemours and Company of Delaware. The combination of the inner and outer fabric walls and the layer of cushioning material provide the ice skate blade guard with flexibility so that the guard can be easily folded and stored in a pocket while providing sufficient protection from the sharp skate blades. Further, the flexbility of the pouch permits the pouch to be attached to the ice skate blade in a quick and easy manner as will be subsequently described. The inner fabric wall 36 absorbs any moisture on the skate blade and the outer fabric wall permits evaporation of the moisture to the environment. The combined moisture removal characteristics of the inner and outer walls help to inhibit rust of the skate blade.

A hook and loop-type fastener 41 is indicated in broken lines in FIG. 1 and in an unfastened state in FIG. 2 indicated by loop component 42 and hook component 44. The loop component 42 and the hook component 44 are attached to the inner wall of fabric on opposing wall portions. One suitable hook and loop fastener used in the present invention is sold under the trademark of Velcro by I. E. Du Pont de Nemours and Company of Delaware. The hook and the loop components are situated on the inner fabric walls so that when the ice skate blade is inserted into the pouch, the hook and loop components are aligned with the opening 22 of the skate blade. As illustrated in FIG. 3, the wall portions 26 and 28 are squeezed together in the directions of arrows 46 and 48, respectively. FIG. 4 illustrates the hook and loop components 42 and 44 extending through the opening 22 and in a fastened state as indicated by 41. Since the flexible wall portions are made of fabric, the wall portions permit easy contacting of the hook and loop components through the opening 22.

The pouch 24 preferably includes reinforced corners 50 and 52 proximate the front and back portions of the pouch. The reinforced corners are preferably reinforced with the net-type material for preventing premature wear of the ice skate blade guard 10 at the front and back corners. Alternatively, the reinforcing net-type material is provided along the entire inside bottom of the pouch.

Although the present invention has been described with reference to preferred embodiments, workers skilled in the art will recognize that changes may be made in form and detail without departing from the spirit and scope of the invention.

What is claimed is:

1. A skate blade guard for use with an ice skate having a blade mounted to a sole of a skate boot and an opening between the sole and the blade, the guard comprising:

a skate blade receiving pouch having first and second flexible wall portions joined at the bottom and at least one end to form an enclosure having a top opening for receiving the skate blade, the wall portions being sufficient in height to extend past the opening of the skate blade the wall portions having an inner wall of fabric, an outer wall of flexible fabric and a cushioning material between the inner and the outer walls, the wall portion being sufficiently flexible so that the pouch is easily folded and reinforcement means made of flexible material located adjacent the bottom of the pouch along its inner wall; and a hook and loop fastener having a hook component and a loop component, each component being attached to one of the inner walls of fabric opposing each other and situated adjacent the opening of the pouch so that when the blade is inserted into the pouch and the first and second wall portions are brought together, the hook and loop components extend through the opening of the skate blade and contact each other thereby securing the pouch to the ice skate blade.

2. The guard of claim 1 wherein the cushioning material is a polyester fiber fill.

3. The guard of claim 1 wherein the pouch is made of one continuous piece of material folded to form a bottom and sewn at the one end to join the wall portions.

4. The guard of claim 3 wherein the material is sewn at both ends to join the wall portions.

* * * * *